US007344451B2

(12) United States Patent
Tang et al.

(10) Patent No.: US 7,344,451 B2
(45) **Date of Patent: *Mar. 18, 2008**

(54) PUTTER-TYPE CLUB HEAD

(75) Inventors: Larry G. Tang, Carlsbad, CA (US); Augustin W. Rollinson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 241 days.

This patent is subject to a terminal disclaimer.

(21) Appl. No.: 10/711,711

(22) Filed: Sep. 30, 2004

(65) Prior Publication Data

US 2006/0068935 A1 Mar. 30, 2006

(51) Int. Cl.
*A63B 69/36* (2006.01)
*A63B 53/04* (2006.01)

(52) U.S. Cl. ..... 473/340; 473/251

(58) Field of Classification Search ..... 473/324–356; D21/736–746, 759
See application file for complete search history.

(56) References Cited

U.S. PATENT DOCUMENTS

| | | | |
|---|---|---|---|
| 1,562,956 | A | 11/1925 | Guerne |
| D148,431 | S | 1/1948 | Lund |
| D196,736 | S | 10/1963 | DeCarlo |
| D229,204 | S | 11/1973 | Romero |
| D230,293 | S | 2/1974 | Gall |
| D230,294 | S | 2/1974 | Gall |
| 3,841,640 | A | 10/1974 | Gaulocher |
| 3,937,474 | A | 2/1976 | Jepson et al. |
| 4,681,322 | A | 7/1987 | Straza et al. |
| 4,688,798 | A | 8/1987 | Pelz |
| 4,754,976 | A | 7/1988 | Pelz |
| 4,801,146 | A | 1/1989 | Honma |
| D309,765 | S | 8/1990 | Pelz |
| D317,962 | S | 7/1991 | Pelz |
| 5,046,740 | A | 9/1991 | D'earth |
| 5,303,922 | A | 4/1994 | Lo |
| 5,447,311 | A | 9/1995 | Viollaz et al. |
| 5,458,332 | A | 10/1995 | Fisher |
| 5,460,377 | A | 10/1995 | Schmidt et al. |
| 5,464,218 | A | 11/1995 | Schmidt et al. |
| 5,482,281 | A | 1/1996 | Anderson |
| 5,485,997 | A | 1/1996 | Schmidt et al. |
| 5,524,331 | A | 6/1996 | Pond |
| 5,575,472 | A | 11/1996 | Maggerman et al. |
| 5,620,382 | A | 4/1997 | Cho et al. |

(Continued)

*Primary Examiner*—Nini F. Legesse
(74) *Attorney, Agent, or Firm*—Michael A. Catania; Elaine H. Lo

(57) ABSTRACT

A putter-type club head (20) having a body (22) and a peripheral mass belt (23) is disclosed herein. The body (22) is preferably composed of an aluminum alloy. The body (22) includes a face portion (24), a crown portion (26), a sole portion (28) and a column portion (30). The crown portion (26) and the sole portion (28) extend rearward from the face portion (24). The peripheral mass belt (23) includes a central mass portion (80), a heel arc member (82) and a toe arc member (84). The face portion (24), the crown portion (26), the sole portion (28) and the peripheral mass belt (23) define a central aperture (32), which separates the crown portion (26) from the sole portion (28) and the face portion (24) from the central mass portion (80). The crown portion (26) preferably has an alignment means (40) thereon for aiming a golf ball during putting.

20 Claims, 7 Drawing Sheets

U.S. PATENT DOCUMENTS 5,674,132 A 10/1997 Fisher
5,685,784 A 11/1997 Butler
D389,208 S 1/1998 Phillips
5,743,813 A 4/1998 Chen et al.
D395,692 S 6/1998 Butler
5,769,736 A 6/1998 Sato
5,816,936 A 10/1998 Aizawa et al.
5,830,078 A 11/1998 McMahan
5,921,871 A 7/1999 Fisher
5,924,939 A 7/1999 Grace et al.
5,931,743 A 8/1999 Baker et al.
5,971,867 A * 10/1999 Galy ..... 473/345
D422,328 S 4/2000 Lannoch
D428,457 S 7/2000 Rollinson et al.
6,224,496 B1 5/2001 Rowland et al.
6,238,302 B1 5/2001 Helmstetter et al.
6,277,986 B1 5/2001 Fisher
6,273,831 B1 8/2001 Dewanjee
6,277,033 B1 8/2001 Krumme et al.
D448,437 S 9/2001 Colucci
D449,085 S 10/2001 Breier et al.
D457,586 S 5/2002 Tang
D458,656 S 6/2002 Tang
6,471,600 B2 * 10/2002 Tang et al. ..... 473/242
6,506,125 B2 * 1/2003 Helmstetter et al. ..... 473/242
6,860,818 B2 * 3/2005 Mahaffey et al. ..... 473/256
D523,102 S * 6/2006 Stites et al. ..... D21/742
7,086,957 B2 * 8/2006 Solheim et al. ..... 473/251
7,147,569 B2 * 12/2006 Tang et al. ..... 473/249
2002/0094884 A1 * 7/2002 Hocknell et al. ..... 473/334

* cited by examiner

PUTTER-TYPE CLUB HEAD

BACKGROUND OF THE INVENTION

1. Field of the Invention

The present invention relates to a putter-type club head. More specifically, the present invention relates to a putter-type club head having a rearward center of gravity.

2. Description of the Related Art

The golf industry has been inventing putters that make the game of golf easier for the high handicap player. One such putter is disclosed in U.S. Pat. No. 4,688,798 to David Peiz. The Pelz patent discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter.

Yet another patent that discloses an alignment means is Great Britain Patent Application Number 4,659,083 to Lilley. The Lilley patent also discloses a group of lines that converge toward the center of the face of a putter.

Another example is Schmidt et al., U.S. Pat. No. 5,470,068, for a Golf Putter With Dished Bottom Surfaces which discloses a putter composed of a single cast material and having a hollow interior.

Another example is Uebelhor, U.S. Pat. No. 6,086,484, which was filed on Mar. 20, 1998 for a Golf Putter Head. Uebelhor discloses a putter head with a U-shaped body and a block within the middle. The block has a lower specific gravity than the U-shaped body.

Yet another example is Rose et al., U.S. Pat. No. 5,951,412 originally filed in January of 1996 for a Golf Club, Particularly A Putter. The Rose patent discloses a center portion composed of a light metal material and the heel and toe portions composed of heavier metals. The metals are forged or cast to create the putter head.

Another example is Fernandez, U.S. Pat. No. 4,793,616 for a Golf Club, which was originally filed in 1984, discloses a lightweight composite material molded to a hard, high density material for distribution of mass. Fernandez discloses a composite shell with a high density insert composed of tungsten or some other high density material.

Although these inventions have provided new and improved putters for making the game of golf more enjoyable for high handicap players, the prior art has not optimized a putter by making it more forgiving and assisting in alignment.

BRIEF SUMMARY OF THE INVENTION

One aspect of the present invention is a putter-type club head having a body and a peripheral mass belt. The body has a face portion, a crown portion, a sole portion and a column portion. The crown portion extends rearward from the face portion to cover the column portion. The sole portion extends rearward from face portion. The peripheral mass belt is attached to the body. The peripheral mass belt has a central mass portion, a heel arc member extending outward from the central mass portion and a toe arc member extending outward from the central mass member.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
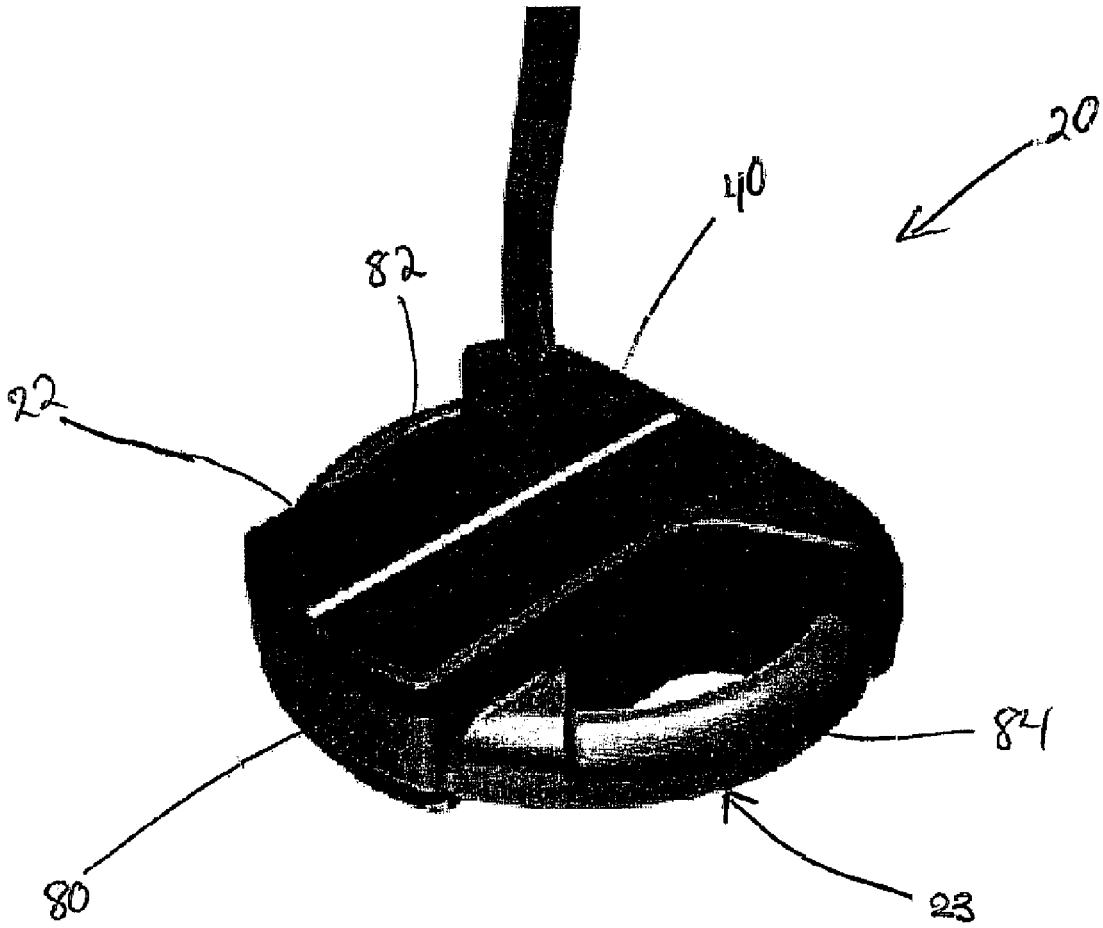
FIG. 1 is a top perspective view of a putter-type club head.
Figure 2:
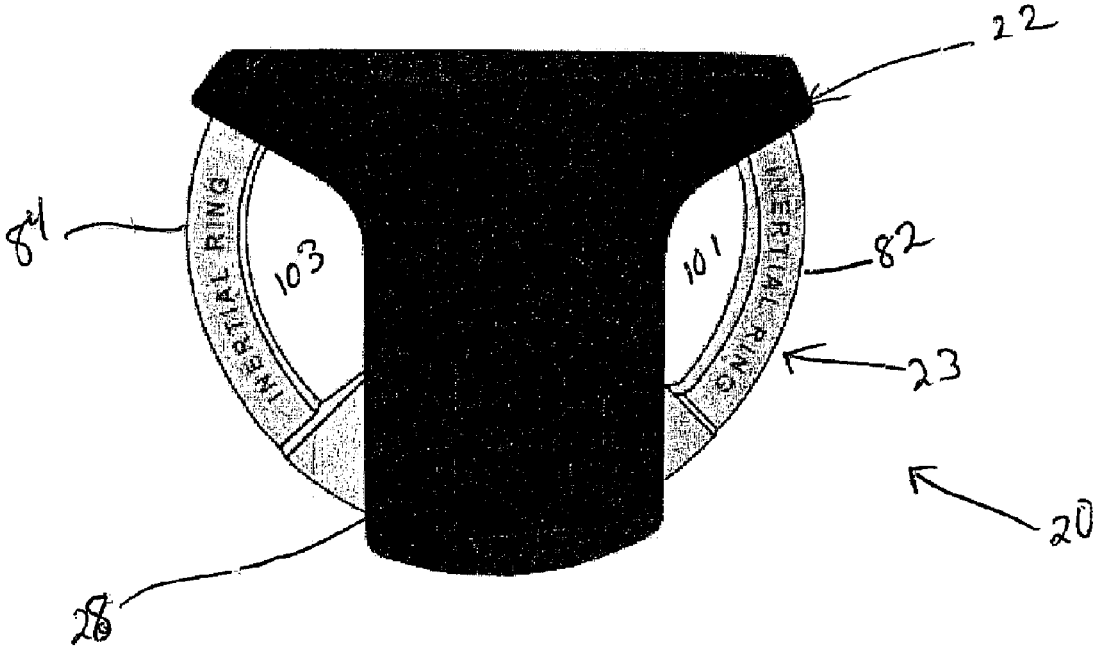
FIG. 2 is a bottom plan view of putter-type club head of FIG. 1.
Figure 3:
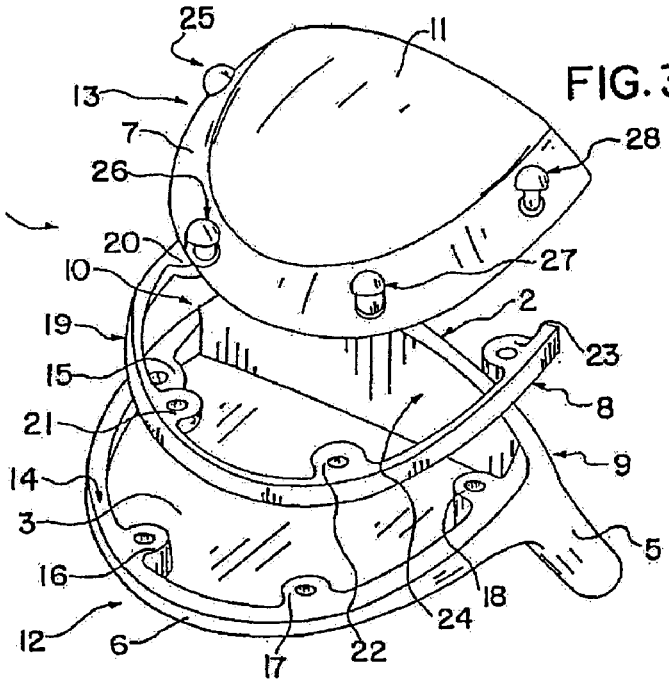
FIG. 3 is a top plan view of putter-type club head of FIG. 1.
Figure 4:
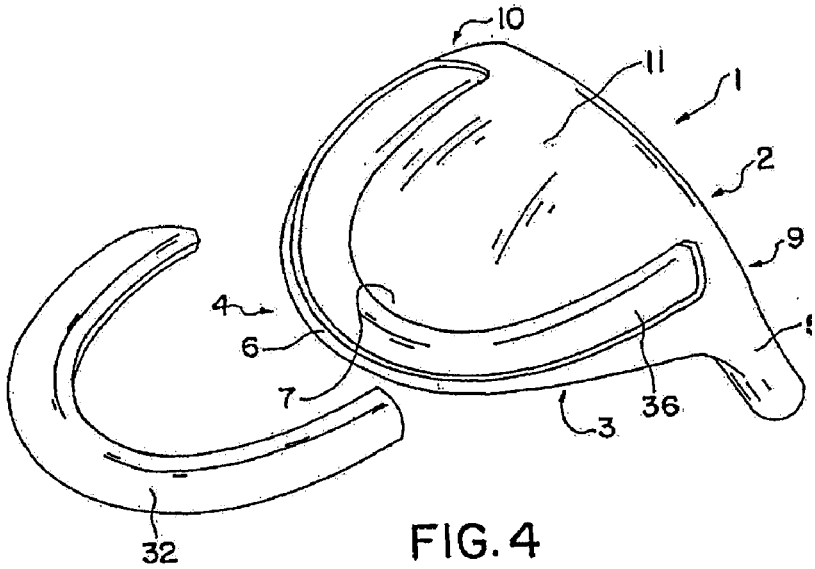
FIG. 4 is a front plan view of putter-type club head of FIG. 1.
Figure 5:
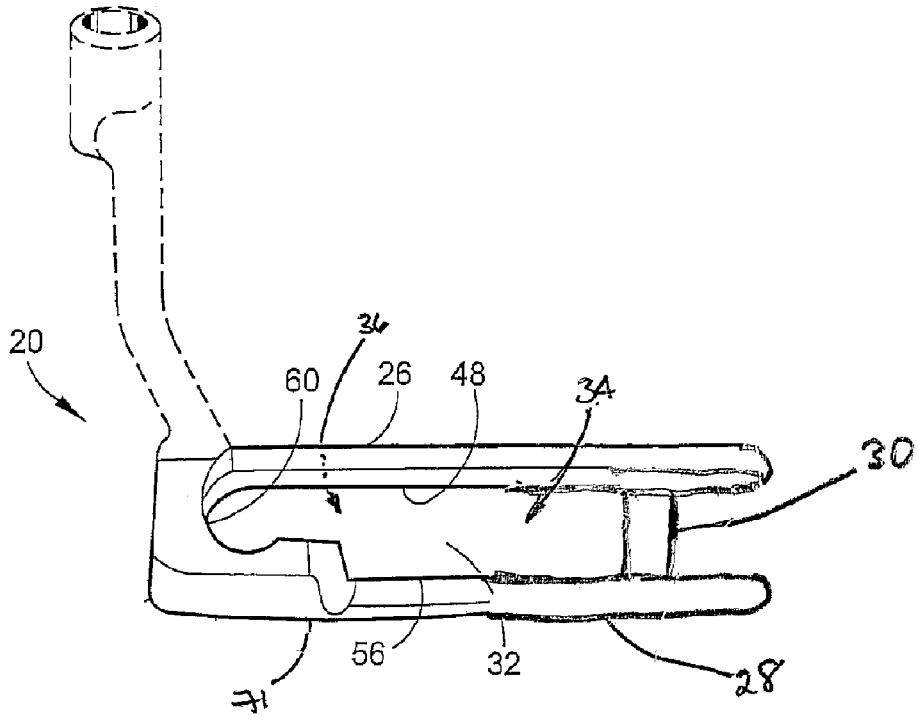
FIG. 5 is a heel side plan view of a body of the putter-type club head of FIG. 1.
Figure 6:
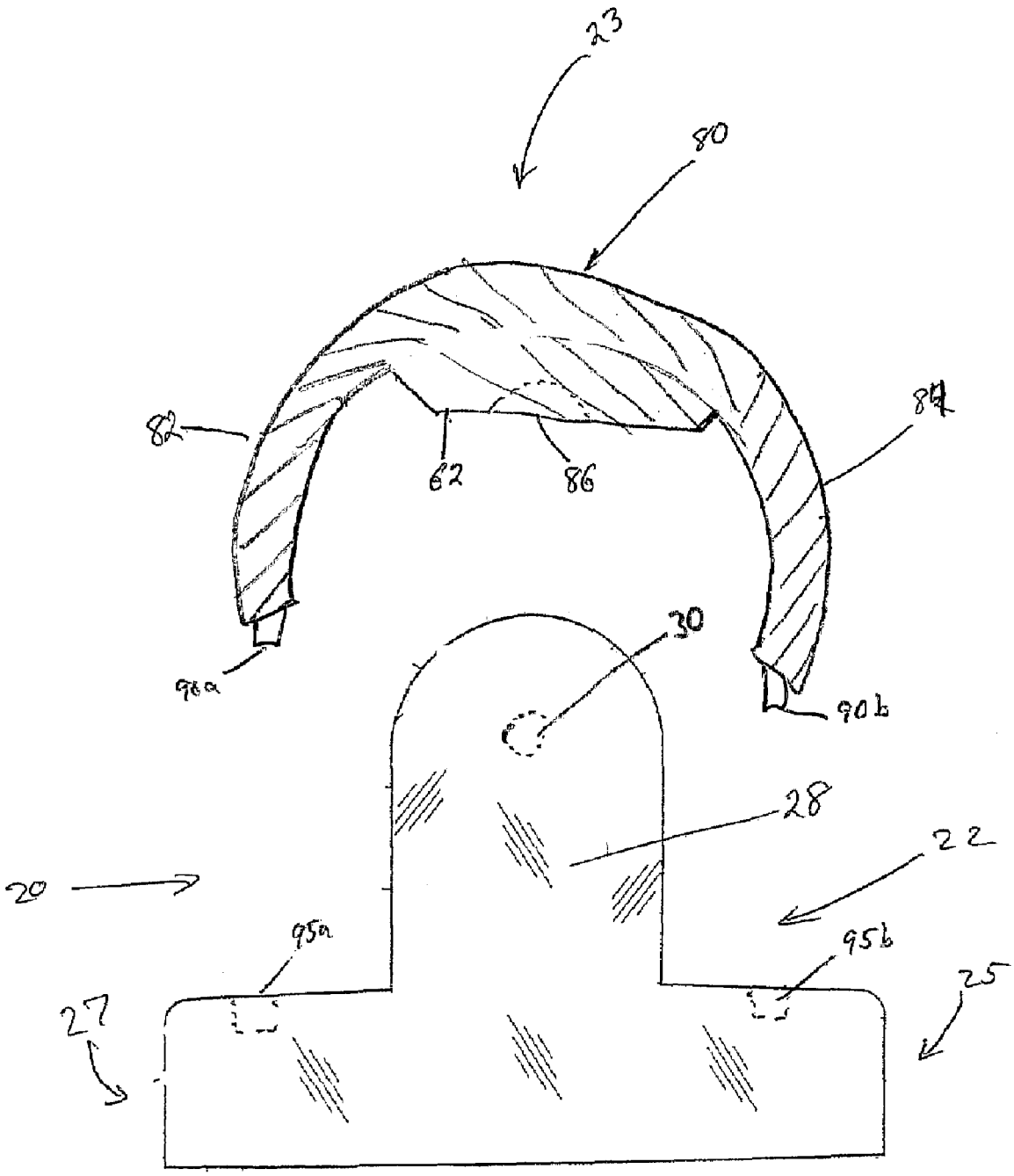
FIG. 6 is an exploded bottom view of the putter-type club head of FIG. 1.
Figure 7:
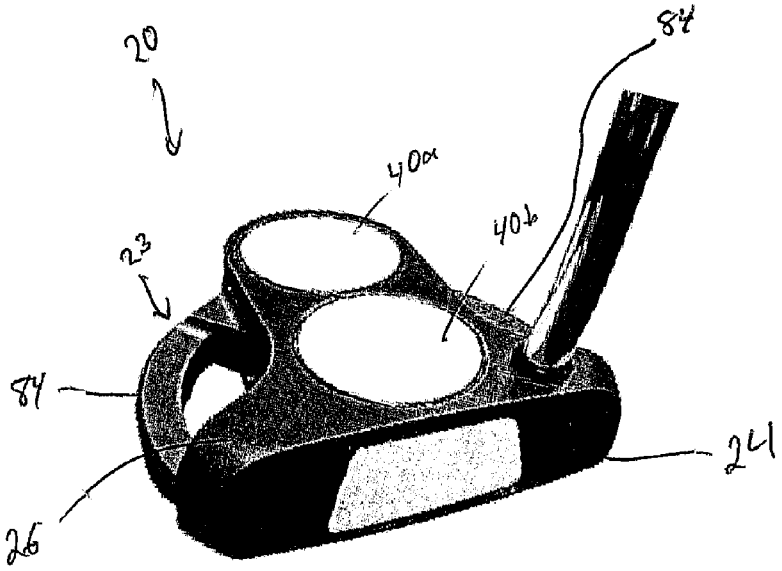
FIG. 7 is a top perspective view of an alternative embodiment of a putter-type club head.
Figure 8:
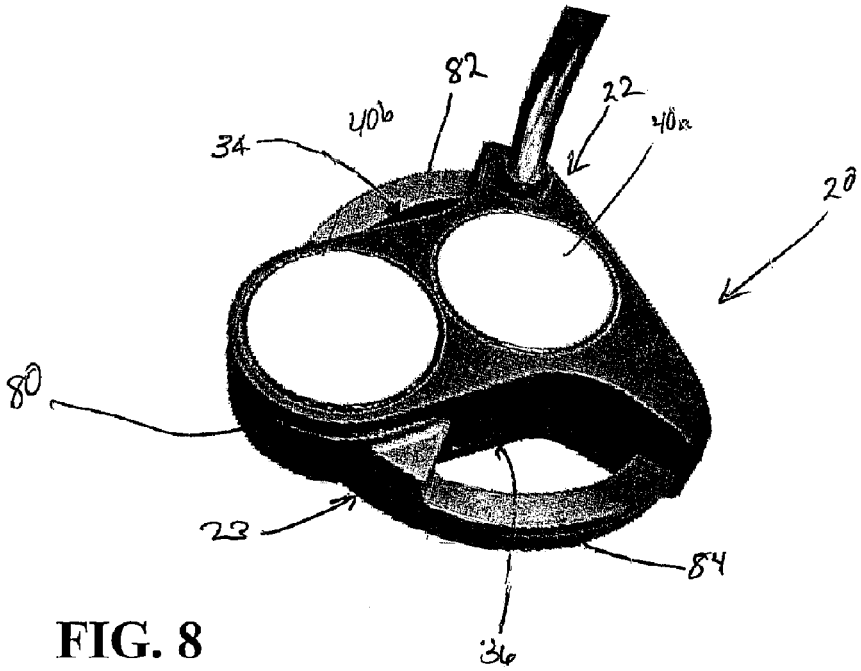
FIG. 8 is a top perspective view of an alternative embodiment of a putter-type club head.

As shown in FIGS. 1-6, a putter-type club head of the present invention is generally designated 20. FIGS. 7-8 illustrate an alternative embodiment of a putter-type club head 20 of the present invention. The club head 20 preferably includes a body 22 and a peripheral mass belt 23. In a preferred embodiment, the body 22 is composed of a material having a density ranging from 0.90 g/cm$^3$ to 6.0 g/cm$^3$. A preferred metal for the body 22 is an aluminum alloy. Alternative materials for the body 22 include aluminum, titanium, titanium alloys, magnesium, magnesium alloys, and the like. The body 22 is preferably formed as a single cast structure using known investment casting techniques. However, those skilled in the pertinent art will recognize that alternative forming techniques such as milling, welding forged or formed pieces, and the like may be utilized without departing from the scope and spirit of the present invention.

The body 22 preferably weighs from 100 grams to 300 grams, more preferably from 150 grams to 200 grams, even more preferably from 160 grams to 180 grams and most preferably 170 grams.

The peripheral mass belt 23 is preferably composed of a material that has a density greater than the density of the material of the body 22. In a preferred embodiment, the peripheral mass belt 23 is composed of a material having a density ranging from 6.0 g/cm$^3$ to 20.0 g/cm$^3$, and more preferably from 7.0 g/cm$^3$ to 10.0 g/cm$^3$. In a preferred embodiment, the peripheral mass belt 23 is composed of stainless steel. In alternative embodiments, the peripheral mass belt 23 is composed of zinc, brass, copper, gold, silver, tungsten, tungsten-based alloys, iron-based alloys, and copper-based alloys.

The peripheral mass belt 23 preferably weighs from 100 grams to 300 grams, more preferably from 150 grams to 200 grams, even more preferably from 160 grams to 180 grams and most preferably 170 grams. In a most preferred embodiment, the body 22 and the peripheral mass belt 23 have the same mass or substantially the same mass. The club head 20 preferably has a mass ranging from 250 grams to 500 grams, more preferably from 300 grams to 400 grams, and most preferably 340 grams.

In a preferred embodiment, the body 22 has a face portion 24, a crown portion 26, a sole portion 28 and a column portion 30. The face portion 24, the crown portion 26, the sole portion 28, the column portion 30 and the peripheral mass belt 23 define a central aperture 32 that extends through the body 22. The central aperture 32 has a heel opening 34 at a heel end 27 of the body 22 and a toe opening 36 at a toe end 25 of the body 22. The central aperture 32 horizontally separates the face portion 24 from the peripheral mass belt 23, and the central aperture 32 vertically separates the crown portion 26 from the sole portion 28. The central aperture 32, in connection with the peripheral mass belt 23, allows for the center of gravity of the club head 20, CG, to be moved rearward from the face portion 24. In a preferred embodiment, the CG of the club head 20 is positioned within the central aperture 32, and thus the CG is not positioned within material of the club head 20 but instead lies outside the material in the space within the central aperture 32. Preferably, the CG is located between 0.25 inch and 1.0 inch from an external surface 71 of the sole portion 28, more preferably 0.50 inch to 0.75 inch, and most preferably 0.73 inch from the external surface 71 of the sole portion 28. Also, preferably the CG of the club head 20 is located 0.50 inch to 2.5 inches rearward from the external surface 58 of the face portion 24, more preferably 0.75 inch to 1.5 inches, and most preferably 0.944 inch from the external surface 58 of the face portion 24.

In addition to assisting in the rearward positioning of the CG, the peripheral mass belt 23 is a rearward support structure for the crown portion 26. The peripheral mass belt 23 preferably ranges from 20 to 50 volume percent of the club head 20 and ranges from 40 to 75 weight percent of the club head 20.

The sole portion 28 preferably has an approximate T-shape. The external surface 71 of the sole portion 28 contacts the ground when the club head 20 is used with a shaft and grip, both not shown, as a putter. The CG of the club head 20 preferably lies above the sole portion 28.

The crown portion 26 extends rearward from the face portion 24. The crown portion 26 has a central elongated section 44 and a front section 46. The front section 46 has a width w' that extends from the heel end 27 to the toe end 25 of the face portion 24, and gradually narrows as the front section 46 transitions into the central elongated section 44. The width, w', preferably ranges from 2.5 inches to 5.0 inches, more preferably from 3.5 inches to 4.5 inches, and most preferably 4.25 inches. The central elongated section 44 has a width w" that is less than the width w' of the front section 46. The width, w", preferably ranges from 1.0 inch to 3.0 inches, more preferably from 1.5 inches to 2.25 inches, and most preferably 1.8 inches. The internal surface 48 of the crown portion 26 partially defines the central aperture 32. The crown portion preferably has a thickness that ranges from 0.10 inch to 0.50 inch, more preferably 0.15 inch to 0.30 inch.

The external surface 38 of the crown portion 26 preferably has an alignment means 40 thereon. The external surface 38 also preferably has a cylindrical rod 54 extending upward therefrom for engagement with a shaft, not shown. As shown in FIGS. 7 and 8, a preferred alignment means 40 is first and second inserts **40*a* and 40*b* disposed within first and second recesses in the crown portion 26. The depth of each of the recesses is preferably within 0.05 inch to 0.50 inch, more preferably 0.1 inch to 0.250 inch. Each of the circular inserts 40*a* and 40*b*** preferably has a thickness ranging from 0.05 inch to 0.50 inch, more preferably 0.1 inch to 0.250 inch.

In a preferred embodiment, each of the circular inserts **40*a* and 40*b* is preferably composed of a thermosetting polyurethane material such as described in U.S. Pat. No. 6,273,831, entitled Golf Club Head with A Polymer Insert, assigned to Callaway Golf (the assignee of the Present Application), which is hereby incorporated by reference in its entirety. Alternatively, each of the circular inserts 40*a* and 40*b* may be composed of a thermoplastic polyurethane. Each of the circular inserts 40*a* and 40*b* is preferably colored white, through painting or doping of the polyurethane with coloring agents, and each circular insert 40*a* and 40*b* preferably has a texture of a golf ball cover. Each of the circular inserts 40*a* and 40*b* preferably has a diameter ranging from 1.62 inches to 1.70 inches, and most preferably 1.68 inches. Those skilled in the art will recognize that more than two circular inserts 40*a* and 40*b*** may be utilized without departing from the scope and spirit of the present invention.

Alternative alignment means are disclosed in U.S. Pat. No. 4,688,798, entitled Golf Club And Head Including Alignment Indicators, assigned to the Callaway Golf (the assignee of the Present Application), which pertinent parts are hereby incorporated by reference. As disclosed in U.S. Pat. No. 4,688,798, the alignment means assists a golfer in properly aiming a golf ball toward a hole when putting. Alternative alignment means, including a large white strip may be utilized in the present invention.

Figure 9:
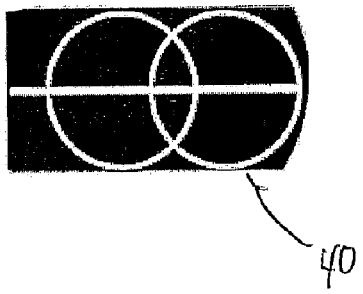
FIG. 9 is an isolated view of one embodiment of an alignment means for a putter-type club head.
Figure 10:
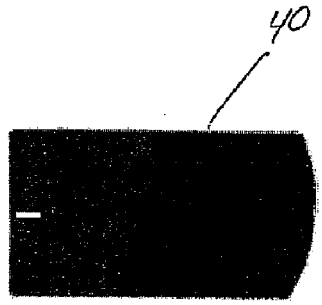
FIG. 10 is an isolated view of one embodiment of an alignment means for a putter-type club head.
Figure 11:
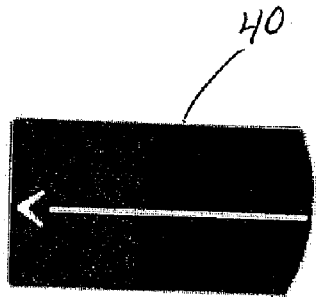
FIG. 11 is an isolated view of one embodiment of an alignment means for a putter-type club head.

FIGS. 9-11 illustrate various alignment means 40 for the club head 20. In these embodiments, the alignments means is a relatively flat strip of a composite material or a thermoplastic material which is placed within a recess, not shown, in the crown portion 26 of the body 22.

The face portion 24 preferably has a thickness ranging from 0.10 inch to 0.50 inch, more preferably 0.20 inch to 0.35 inch. The face portion 24 has an internal surface 60 that partially defines the central aperture 32. The external surface 58 of the face preferably has a face recess, not shown, therein with a face insert 50 disposed therein such as disclosed in U.S. Pat. No. 6,238,302, entitled A Golf Club Head With An Insert Having Integral Tabs, assigned to Callaway Golf (the assignee of the Present Application), which is hereby incorporated by reference in its entirety. As disclosed in U.S. Pat. No. 6,238,302, the face insert 50 is preferably composed of a thermosetting polyurethane material and is preferably colored white. In an alternative embodiment, the face portion 24 is a non-insert blade as is known in the art.

The body 22 preferably has a length, L, from the face portion 24 to the rearward most end of the peripheral mass belt 23, preferably ranging from 2.5 inches to 4.5 inches, more preferably from 3.0 inches to 4.0 inches, and most preferably 3.43 inches. In one alternative embodiment, the body 22 has a length, L, that is equal to the width, w'.

As mentioned previously, the central aperture 32 is defined by the internal surface 60 of the face portion 24, the internal surface 48 of the crown portion 26, the internal surface 56 of the sole portion 28 and the internal surface 62 of the peripheral mass belt 23, and the internal surface of the column portion 30. The distance from the internal surface 48 of the crown portion 26 to the internal surface 56 of the sole portion 28 preferably ranges from 0.01 inch to 1.50 inches, more preferably 0.25 inch to 1.0 inch, and most preferably 0.5 inch. The distance from the internal surface 60 of the face portion 24 to the internal surface 62 of peripheral mass belt 23 preferably ranges from 1.0 inch to 3.50 inches, more preferably from 1.5 inches to 3.0 inches, and most preferably 2.00 inches.

The peripheral mass belt 23 preferably includes a central mass portion 80, a heel arc member 82 and a toe arc member 84. The heel arc member 82 and the toe arc member 84 extend outward from opposing ends of the central mass portion 80. The central mass portion 80 has a recess 86 for placement of the column portion 30 therein. The heel arc member 82 has a projection 90*a* for placement within a recess 95*a* (shown in dashed lines in FIG. 6) of the face portion 24. The toe arc member 84 has a projection 90*b* for placement within a recess 95*b* (shown in dashed lines in FIG. 6) of the face portion 24. The peripheral mass belt 23 is preferably bonded to the body 22 using an adhesive, with the adhesive preferably placed around the column portion 30 that engages the central mass portion 80 and within the recesses 95*a-b*. Alternatively, the peripheral mass belt 23 is press-fitted into engagement with the body, or secured using mechanical fasteners, such as screws.

The putter-type club head 20 preferably has a moment of inertia about the Izz axis through the center of gravity ranging from 3750 g-cm$^2$ to 4200 g-cm$^2$, and more preferably 3950 g-cm$^2$ to 4100 g-cm$^2$. The Izz axis extends from the sole to the crown.

In a preferred embodiment, the heel arc member 82 and the body 22 form a heel space 101, and the toe arc member 84 and the body 22 form a toe space 103. The heel space 101 and the toe space 103 allow for the mass of the club head 20 to be extended outward from the center of gravity to increase the moment of inertia without adding more mass to the club head 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A putter-type club head comprising:

a body having a face portion, a crown portion, a sole portion and a column portion, the crown portion extending rearward from the face portion to cover the column portion, the sole portion extending rearward from face portion; and a peripheral mass belt attached to the body, the peripheral mass belt having a central mass portion, a heel arc member extending outward from the central mass portion and a toe arc member extending outward from the central mass member, wherein the heel arc member is attached to the face portion of the body and the toe arc member is attached to the face portion of the body;

wherein the face portion, the crown portion, the sole portion and the central mass portion of the peripheral mass belt define a central aperture through the body having a heel end opening and a toe end opening, and the central aperture separates the crown portion from the sole portion and the face portion from the central mass portion;

wherein the heel arc member and the body define an open heel space, and the toe arc member and the body define an open toe space.

2. The putter-type club head according to claim 1 further comprising a plurality of recesses on an external surface of the crown portion, each of the plurality of recesses having a circular shape with a diameter ranging from 1.62 inches to 1.70 inches;

a plurality of circular inserts, each of the plurality of circular inserts disposed within a corresponding recess of the plurality of recesses.

3. The putter-type club head according to claim 1 wherein each of the plurality of circular inserts is composed of a thermosetting polyurethane material, and each of the plurality of circular inserts has a white color.

4. A putter-type club head comprising:

a face portion having a recess with a face insert disposed therein;

a sole portion extending rearward from the face portion, the sole portion having an internal surface and an external surface;

a crown portion extending rearward from the face portion, the crown portion having a central elongated section and a forward section, the forward section having a width from a heel end of the face portion to a toe end of the face portion from between 3.0 inches to 5.0 inches, the forward section having a width greater than a width of the central elongated portion;

an alignment means disposed on an external surface of the crown portion; and a peripheral mass belt attached to the body, the peripheral mass belt having a central mass portion, a heel arc member extending outward from the central mass portion and a toe arc member extending outward from the central mass member, wherein the heel arc member is attached to the face portion and the toe arc member is attached to the face portion;

wherein the heel arc member and the body define an open heel space, and the toe arc member and the body define an open toe space.

5. The putter-type club head according to claim 4 wherein the center of gravity of the club head is located from between 0.25 inch to 1.0 inch upward from the external surface of the sole portion.

6. The putter-type club head according to claim 4 wherein the center of gravity of the club head is located 0.50 inch to 2.5 inches rearward from the external surface of the face portion.

7. The putter-type club head according to claim 4 wherein the alignment means is composed of two circular inserts.

8. The putter-type club head according to claim 7 wherein the two circular inserts are composed of a thermosetting polyurethane.

9. The putter-type club head according to claim 4 wherein the alignment means is composed of two intersecting circles.

10. A putter-type club head comprising:

a body having a face portion, a crown portion, a sole portion and a column portion, the crown portion extending rearward from the face portion to cover the column portion, the sole portion extending rearward from face portion; and a peripheral mass belt attached to the body, the peripheral mass belt having a central mass portion, a heel arc member extending outward from the central mass portion and a toe arc member extending outward from the central mass member, wherein the heel arc member is attached to the face portion of the body and the toe arc member is attached to the face portion of the body;

wherein the puffer-type club head has length from the face portion to a rearward most end of the aft mass portion ranging from 2.5 inches to 4.5 inches, wherein the heel arc member and the body define an open heel space, and the toe arc member and the body define an open toe space.

11. The putter-type club head according to claim 10 wherein the peripheral mass belt ranges from 20 to 50 volume percent of the putter-type club head and ranges from 40 to 60 weight percent of the body.

12. The puffer-type club head according to claim 10 wherein the peripheral mass belt is composed of stainless steel.

13. A putter-type club head comprising:

a body having a face portion, a crown portion, a sole portion and a column portion, the crown portion extending rearward from the face portion to cover the column portion, the sole portion extending rearward from face portion; and a peripheral mass belt attached to the body, the peripheral mass belt having a central mass portion, a heel arc member extending outward from the central mass portion and a toe arc member extending outward from the central mass member wherein the heel arc member is attached to the face portion of the body and the toe arc member is attached to the face portion of the body;

wherein the body and the peripheral mass belt have substantially equal mass, and the mass of each of the body and the peripheral belt ranges from 160 grams to 180 grams, and wherein the heel arc member and the body define an open heel space, and the toe arc member and the body define an open toe space.

14. A putter-type club head comprising:

a body having a face portion, a crown portion, a sole portion and a column portion, the crown portion extending rearward from the face portion to cover the column portion, the sole portion extending rearward from face portion; and a peripheral mass belt attached to the body, the peripheral mass belt having a central mass portion, a heel arc member extending outward from the central mass portion and a toe arc member extending outward from the central mass member, wherein the heel arc member is attached to the face portion of the body and the toe arc member is attached to the face portion of the body;

wherein the heel arc member and the body forms an open heel space and the toe arc member and the body forms an open toe space.

15. The putter-type club head according to claim 14 further comprising an alignment means disposed on the crown portion.

16. The putter type-club head according to claim 15 wherein the alignment means is a large white strip.

17. The putter-type club head according to claim 14 wherein the body is composed of a material selected from the group consisting of aluminum, aluminum alloy, magnesium, magnesium alloy, titanium and titanium alloy.

18. The putter-type club head according to claim 14 wherein the body is composed of a material having a density ranging from 0.90 g/cm$^3$ to 6.0 g/cm$^3$.

19. The putter-type club head according to claim 14 wherein the peripheral mass belt is composed of a material having a density ranging from 7.00 g/cm$^3$ to 10.0 g/cm$^3$.

20. A putter-type club head comprising:

a body composed of an aluminum material having a density ranging from 2.0 g/cm$^3$ to 3.0 g/cm$^3$, a body having a face portion, a crown portion, a sole portion and a column portion, the crown portion extending rearward from the face portion to cover the column portion, the sole portion extending rearward from face portion; and a peripheral mass belt attached to the body, the peripheral mass belt having a central mass portion, a heel arc member extending outward from the central mass portion and a toe arc member extending outward from the central mass member, the peripheral mass belt composed of a material having a density ranging from 6.0 g/cm$^3$ to 20.0 g/cm$^3$,wherein the heel arc member is attached to the face portion of the body and the toe arc member is attached to the face portion of the body;

wherein the heel arc member and the body define an open heel space, and the toe arc member and the body define an open toe space.

* * * * *